US009630084B2

(12) United States Patent
Yurkin et al.

(10) Patent No.: US 9,630,084 B2
(45) Date of Patent: Apr. 25, 2017

(54) INLINE SKATE SNEAKER

(71) Applicants: Vladimir Yurkin, Sands Point, NY (US); Semen Andreevich Bolotnik, Karaganda (KZ); Ruslan Igorevich Antonenko, Karaganda (KZ)

(72) Inventors: Vladimir Yurkin, Sands Point, NY (US); Semen Andreevich Bolotnik, Karaganda (KZ); Ruslan Igorevich Antonenko, Karaganda (KZ)

( * ) Notice: Subject to any disclaimer, the term of this patent is extended or adjusted under 35 U.S.C. 154(b) by 56 days.

(21) Appl. No.: 14/633,338

(22) Filed: Feb. 27, 2015

(65) Prior Publication Data

US 2016/0250545 A1 Sep. 1, 2016

(51) Int. Cl.

| | |
|---|---|
| ***A63C 17/02*** | (2006.01) |
| ***A63C 17/00*** | (2006.01) |
| *A43B 5/16* | (2006.01) |
| *A63C 17/06* | (2006.01) |

(52) U.S. Cl.

CPC ..... *A63C 17/008* (2013.01); *A43B 5/16* (2013.01); *A63C 17/06* (2013.01)

(58) Field of Classification Search

CPC ..... A63C 17/008; A63C 17/20; A63C 17/00; A63C 17/06; A63C 17/067; A63C 17/061; A63C 5/16; A63C 5/1633

See application file for complete search history.

(56) References Cited

U.S. PATENT DOCUMENTS

| | | | | | |
|---|---|---|---|---|---|
| 3,884,485 | A * | 5/1975 | Walle | A43B 5/1633 | 280/841 |
| 5,803,469 | A * | 9/1998 | Yoham | A63C 17/008 | 280/11.27 |
| 5,887,898 | A * | 3/1999 | Petrosino | A63C 17/008 | 280/825 |
| 6,042,125 | A * | 3/2000 | Wu | A63C 17/20 | 280/11.208 |
| 6,120,039 | A * | 9/2000 | Clementi | A43B 5/1633 | 280/11.19 |
| 6,572,120 | B2 * | 6/2003 | Chang | A63C 17/20 | 280/11.223 |
| 6,634,656 | B1 * | 10/2003 | Gervasoni | A43B 5/1633 | 280/11.223 |
| 7,036,829 | B2 * | 5/2006 | Maxwell | A63C 17/008 | 280/11.223 |
| 7,232,131 | B2 * | 6/2007 | Hurst | A63C 17/008 | 280/11.27 |
| 8,091,900 | B2 * | 1/2012 | Moon | A43B 5/1633 | 280/11.19 |
| 8,915,502 | B2 * | 12/2014 | Pennerath | A43B 3/246 | 280/11.19 |

(Continued)

*Primary Examiner* — James M Dolak
(74) *Attorney, Agent, or Firm* — Dunlap Bennett & Ludwig PLLC

(57) ABSTRACT

An inline skating shoe is provided. The shoe includes a sole on the bottom with a wheel recess. The present invention may include at least one wheel assembly within the wheel recess, such as a plurality of wheel assemblies. Each wheel assembly may include a wheel base attached to the sole, a wheel bracket pivotally attached to the wheel base, and at least one wheel rotatably secured to the wheel bracket. The wheel assemblies include a deployed position in which the wheel bracket is pivoted away from the wheel base and a retracted position in which the wheel bracket is pivoted towards the wheel base.

14 Claims, 5 Drawing Sheets

(56) References Cited

U.S. PATENT DOCUMENTS

| | | | | |
|---|---|---|---|---|
| 2002/0105154 | A1* | 8/2002 | Henselder | A63C 17/008 280/11.233 |
| 2003/0102642 | A1* | 6/2003 | Wang | A43B 5/1633 280/11.233 |
| 2004/0155415 | A1* | 8/2004 | Seleznev | A63C 17/20 280/11.227 |
| 2008/0191432 | A1* | 8/2008 | Jeon | A63C 17/008 280/11.27 |
| 2011/0025002 | A1* | 2/2011 | Park | A43B 5/1633 280/11.19 |

* cited by examiner

INLINE SKATE SNEAKER

BACKGROUND OF THE INVENTION

The present invention relates to inline skates and, more particularly, to a sneaker that is convertible into an inline skate.

Inline skates are a type of roller skate used for inline skating. Unlike quad skates, which have two front and two rear wheels, inline skates have four or five wheels arranged in a single line. Inline skates allow users to travel faster as opposed to walking or running. However, inline skates are typically used for recreational purposes only because replacing inline skates and shoes is a hassle. Currently, certain sneakers include a wheel attached to the heel. However, wheeling around in the sneakers is very slow and the sneakers are not an effective mode of transportation.

As can be seen, there is a need for an improved sneaker and inline skate combination for increased speed in transportation.

SUMMARY OF THE INVENTION

In one aspect of the present invention, an inline skating shoe comprises: a sole on the bottom of the shoe comprising a wheel recess; at least one wheel assembly within the wheel recess and aligned from a front of the sole to a rear of the sole, wherein the wheel assembly comprises: a wheel base attached to the sole; a wheel bracket pivotally attached to the wheel base; and at least one wheel rotatably secured to the wheel bracket, wherein the wheel assemblies comprise a deployed position comprising the wheel bracket pivoting away from the wheel base and a retracted position comprising the wheel bracket pivoting towards the wheel bases.

In another aspect of the present invention, an inline skating shoe comprises: a sole on the bottom of the shoe comprising a wheel recess; at least one wheel assembly within the wheel recess and aligned from a front of the sole to a rear of the sole, wherein the wheel assembly comprises: a wheel base attached to the sole; a wheel bracket pivotally attached to the wheel base, wherein the wheel bracket comprises a top end comprising a first corner and a second corner, wherein the first corner comprises a track stem slidably engaged with a track guide slot formed in the wheel base; and at least one wheel rotatably secured to the wheel bracket; a crutch comprising a first end opposite to a second end, wherein the first end is pivotally mounted to the sole by an anchor and the second end is pivotally mounted to an outer surface of the wheel bracket, wherein the wheel assemblies comprise a deployed position comprising the wheel bracket pivoting away from the wheel base and a retracted position comprising the wheel bracket pivoting towards the wheel bases; and a locking mechanism operable to lock the wheel assembly in the deployed position and retracted position.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

The present invention includes walking sneakers with retractable roller wheels inside for skating. An alternative to walking, the present invention allows user to travel to their destinations faster in a variety of terrain while in the comfort of sneakers. By manually switching between walking and roller mode by triggering the latch in the wheel base, the roller wheels open and lock to their vertical position which allow the user to start skating to their desired locations. Switching between the walking and skating mode is very easy and takes less than five seconds without the need to take the shoes off or sit down to activate the skating mode.

Figure 1:
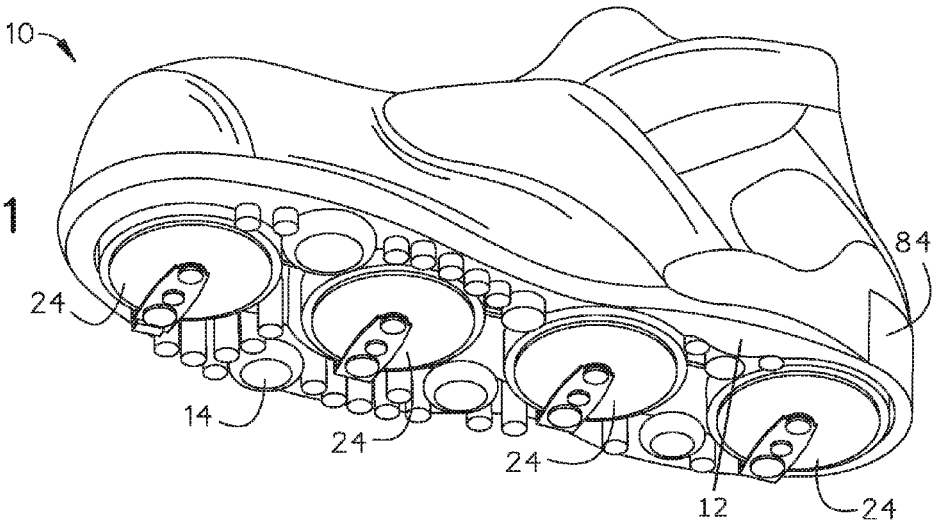
FIG. 1 is a bottom perspective view of the present invention shown in a retracted and locked configuration.
Figure 2:
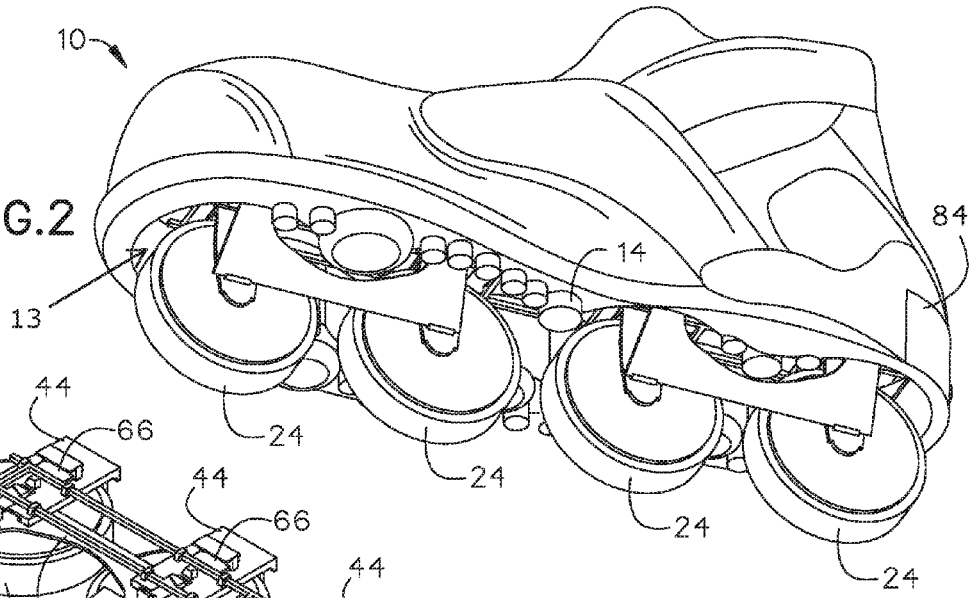
FIG. 2 is a bottom perspective view of the present invention shown in a deployed and locked configuration.
Figure 3:
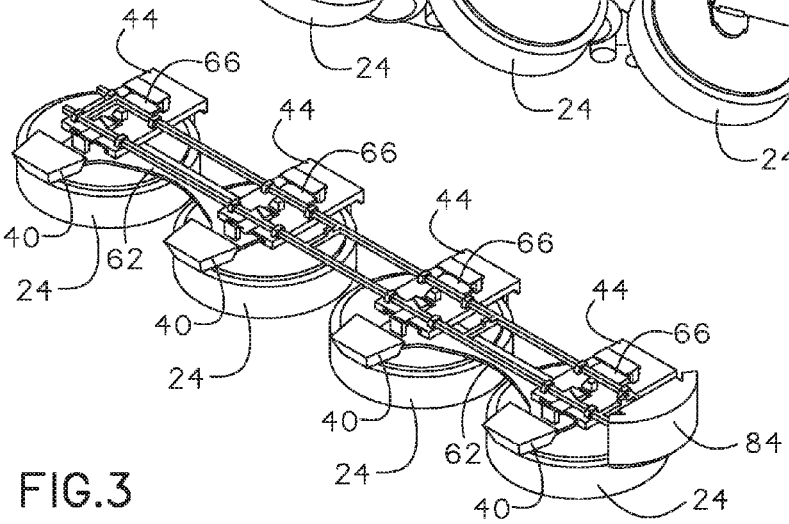
FIG. 3 is a top perspective view of the main mechanical assembly shown in a retracted and locked configuration.
Figure 4:
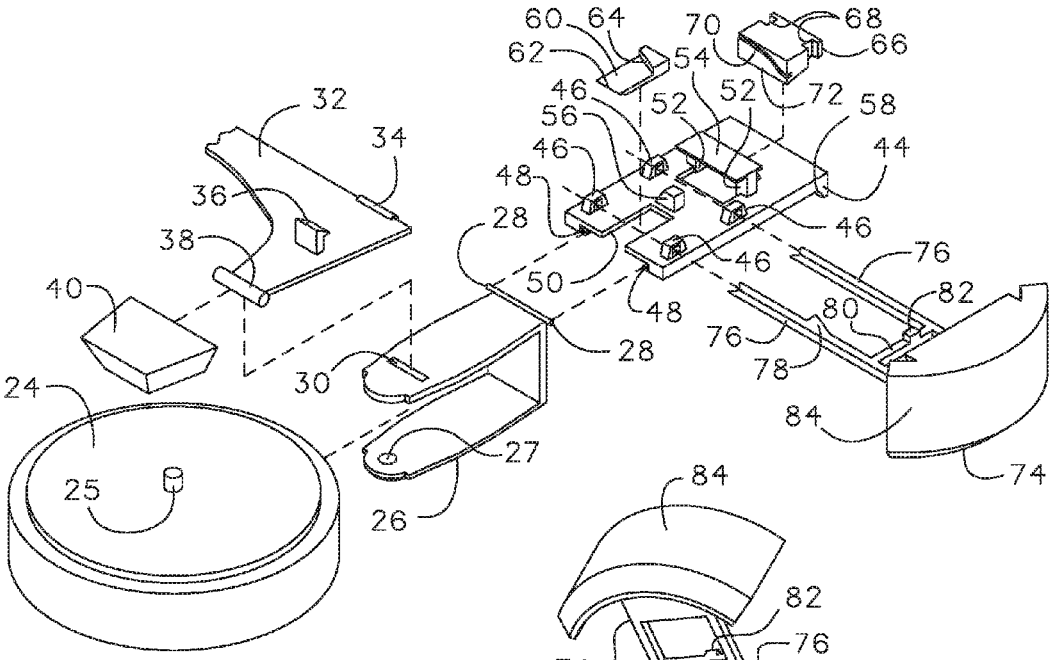
FIG. 4 is a top perspective detail exploded view of the primary components and omitting or breaking multiple other components for illustrative clarity.
Figure 5:
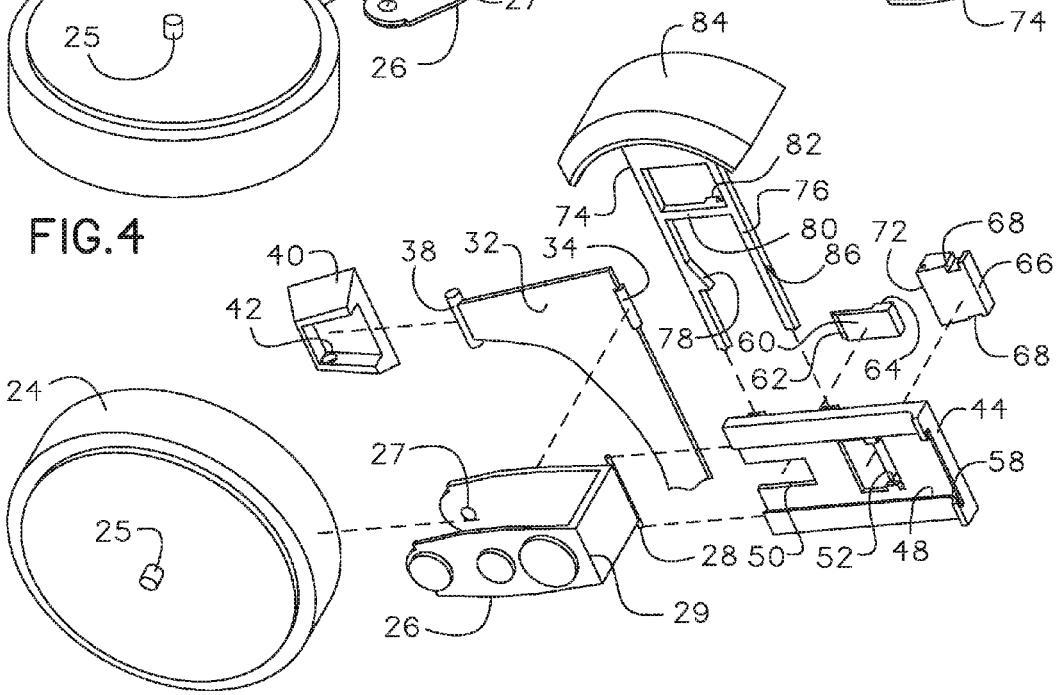
FIG. 5 is a bottom perspective detail exploded view of the primary components and omitting or breaking multiple other components for illustrative clarity.
Figure 6:
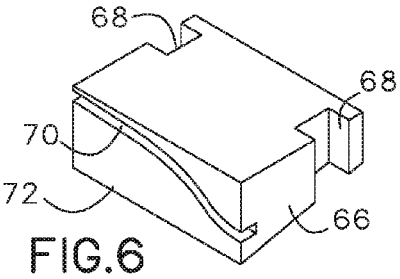
FIG. 6 is a perspective view of the present invention of the wheel bracket lock only.
Figure 7:
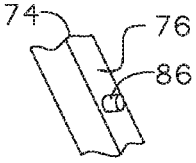
FIG. 7 is a perspective detail view of the present invention the ram only.
Figure 8:
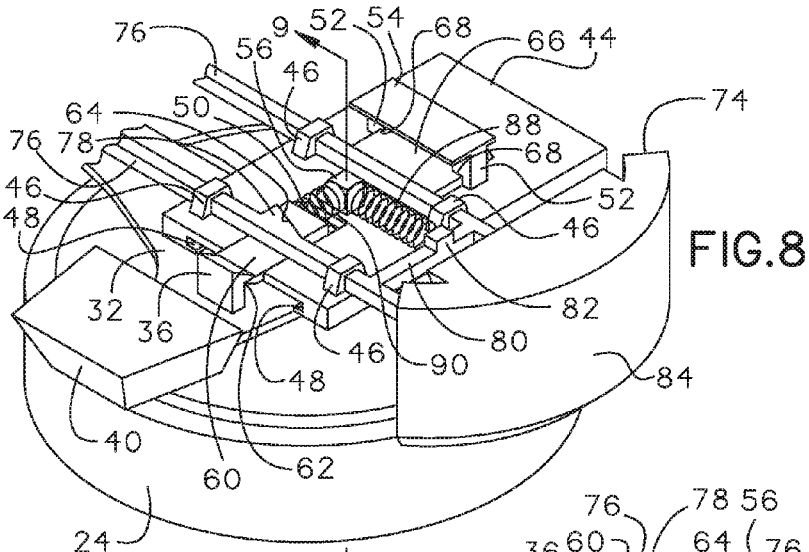
FIG. 8 is a detail perspective view of the present invention demonstrating a select group of components representative of the primary mechanical concept shown in retracted and locked configuration.
Figure 9:
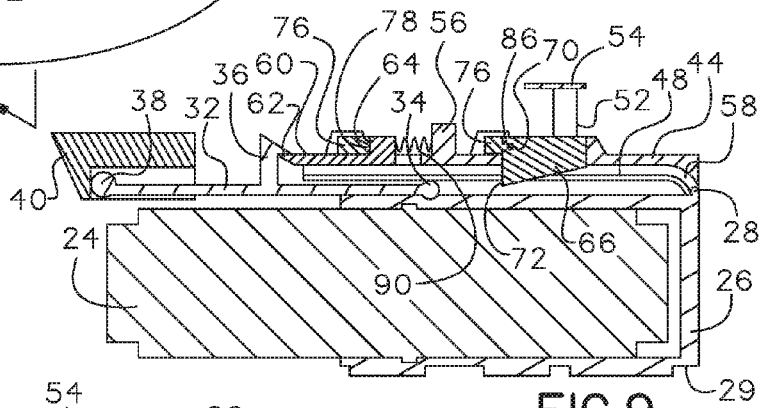
FIG. 9 is a section detail view of the present invention along line 9-9 in FIG. 8.
Figure 10:
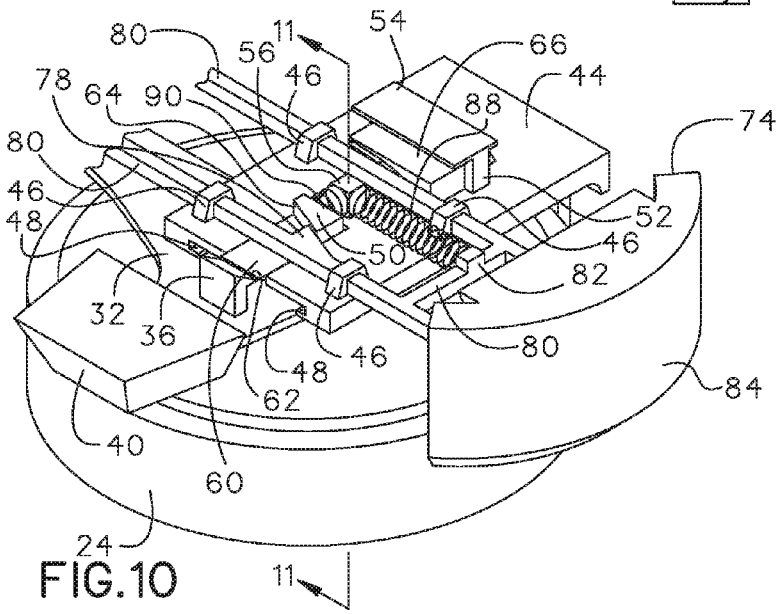
FIG. 10 is a detail perspective view of the present invention demonstrating a select group of components representative of the primary mechanical concept shown in the retracted and unlocked configuration.
Figure 11:
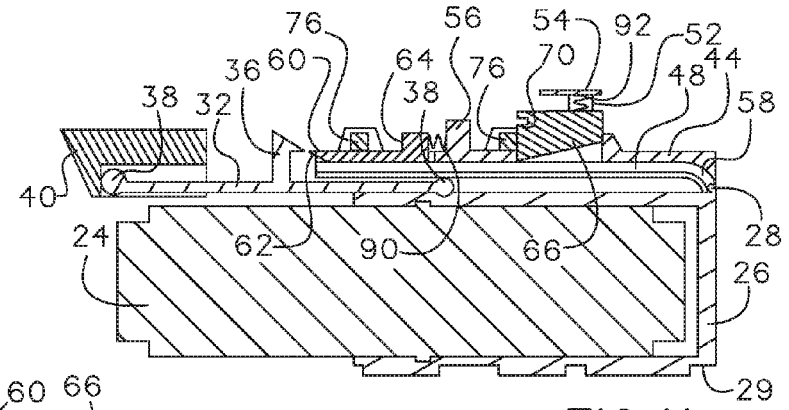
FIG. 11 is a section detail view of the present invention along line 11-11 in FIG. 10.
Figure 12:
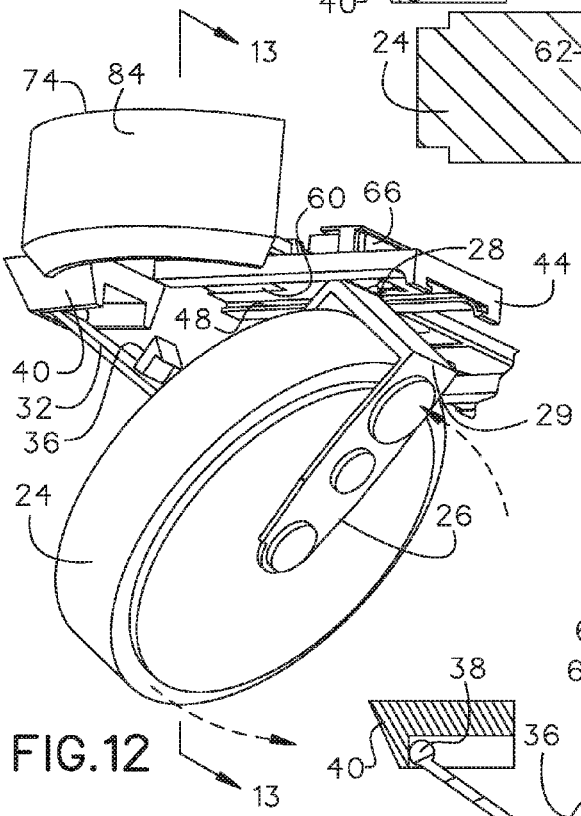
FIG. 12 is a detail perspective view of the present invention demonstrating a select group of components representative of the primary mechanical concept shown in a deployed, unlocked and mid-transformed configuration.
Figure 13:
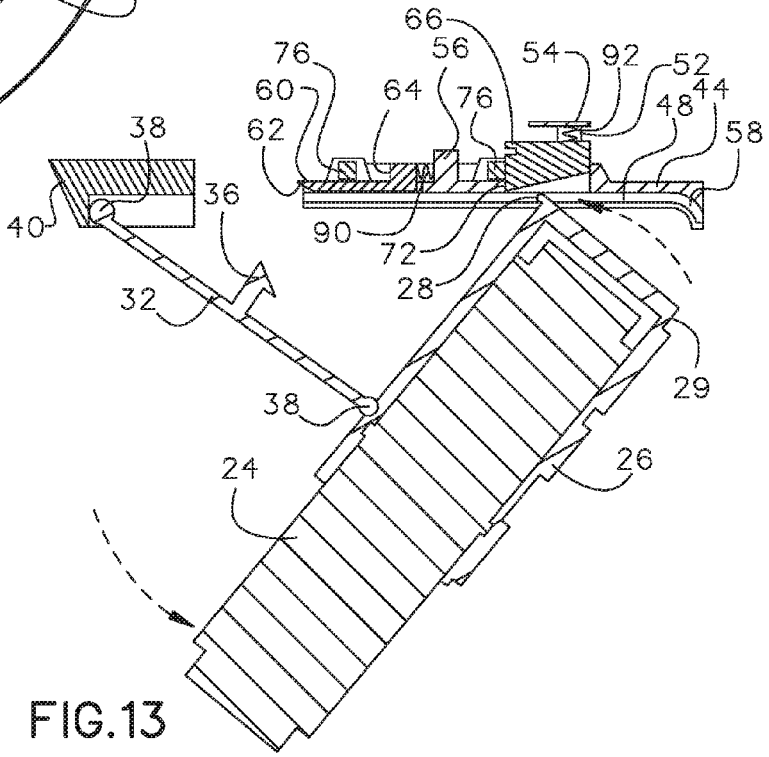
FIG. 13 is a section detail view of the present invention along line 13-13 in FIG. 12.
Figure 14:
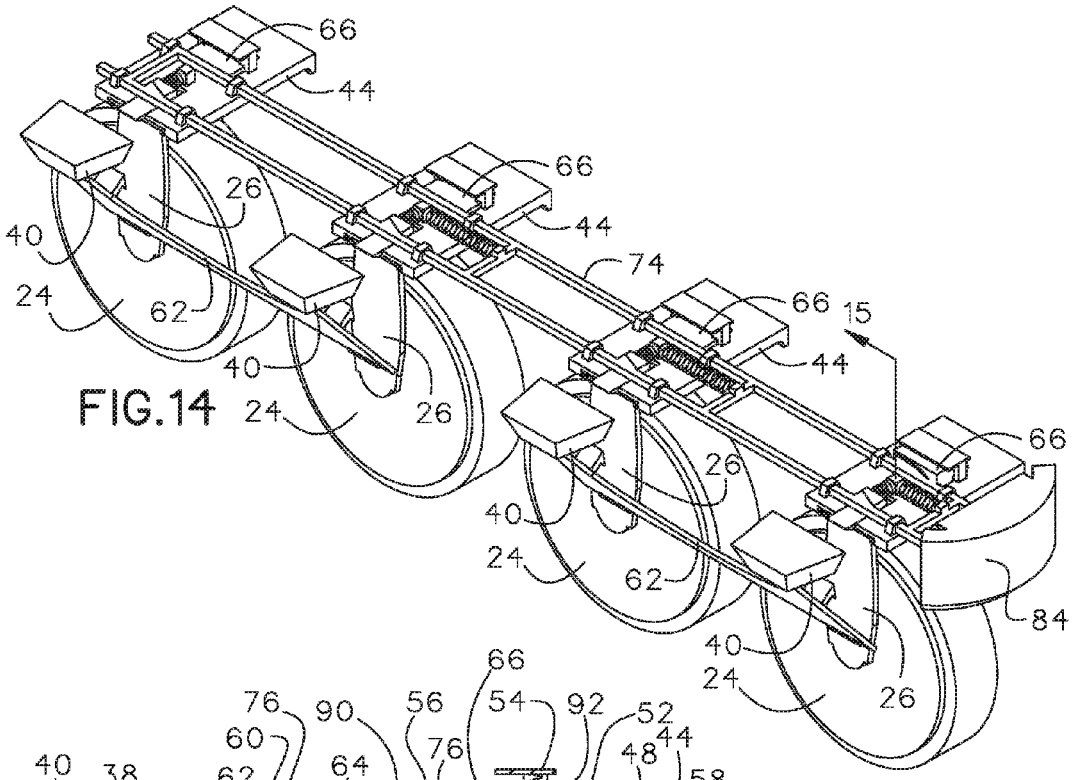
FIG. 14 is a top perspective view of the main mechanical assembly shown in a deployed and locked configuration.
Figure 15:
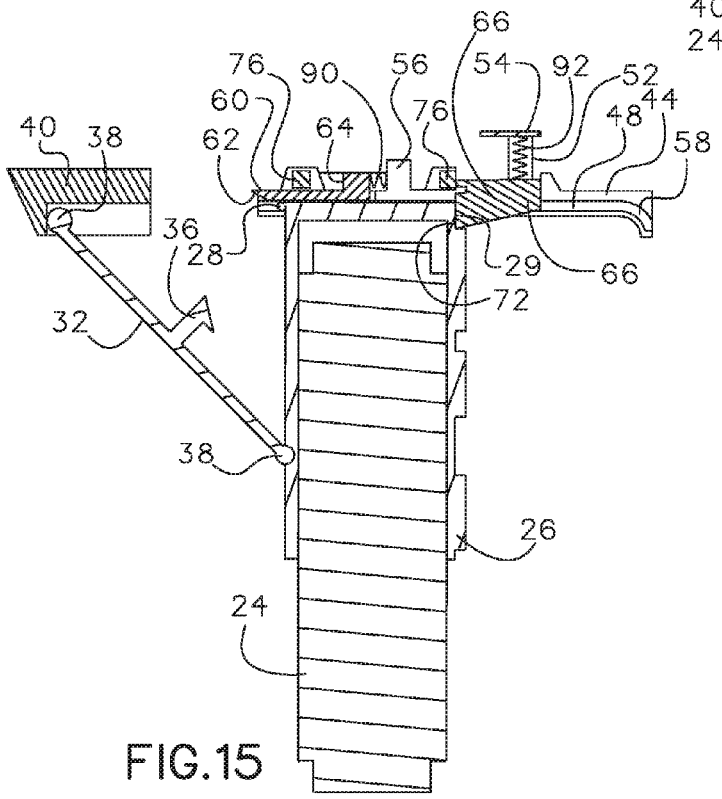
FIG. 15 is a section detail view of the present invention along line 15-15 in FIG. 14.

Referring to FIGS. 1 through 15, the present invention includes an inline skating shoe 10. The shoe 10 includes a sole 12 on the bottom with a wheel recess 13. The present invention may include at least one wheel assembly within the wheel recess 13, such as a plurality of wheel assemblies. As illustrated in the Figures, the present invention may include four wheel assemblies. Each wheel assembly may include a wheel base 44 attached to the sole 12, a wheel bracket 26 pivotally attached to the wheel base 44, and at least one wheel 24 rotatably secured to the wheel bracket 26. The wheel assemblies include a deployed position in which the wheel bracket 26 is pivoted away from the wheel base 44 and a retracted position in which the wheel bracket 26 is pivoted towards the wheel base 44.

In certain embodiments, the sole 12 may include a plurality of bumpers 14 that form the wheel recess 13 in between. The wheel bracket 26 may be substantially parallel with the wheel base 44 in the retracted position and the wheel bracket 26 may be substantially perpendicular with the wheel base 44 in the deployed position. Therefore, the deployed position allows a user to use the shoe 10 as inline skates for fast transportation, and the retracted position allows the user to walk when needed, such as on rough terrain. In the retracted position, the plurality of bumpers 14 protrude from the sole 12 beyond the wheels 24 so that the wheels 24 do not interfere with walking.

The wheel brackets 26 of the present invention may include a top having a first corner and a second corner. The first corner may include a track stem 28 and the second corner may be a lock corner 29. The wheel brackets 26 further include two arms extending downward from the top forming wheel cavities in between the inner surfaces of the arms. The inner surface of each of the arms may include pivot points 27. Pivot pegs 25 of the wheels 24 may fit within the pivot points 27, thereby rotatably attaching the wheels 24 within the wheel brackets 26. An outer surface of one of the arms may include a pivot receiver 30.

In certain embodiments, the present invention may further include a crutch bracket 32. The crutch bracket 32 may include a first end and a second end. The first end includes a first crutch pivot peg 38. The second end includes a second crutch pivot peg 34. The second crutch pivot peg 34 fits within the pivot receiver 30 and thereby pivotally attaches the crutch bracket 32 and the wheel bracket 26. The crutch bracket 32 may include an inner surface and an outer surface. A hook 36 may protrude from the inner surface facing towards the wheel base 44.

The present invention may further include anchors 40. The anchors 40 may be attached to the sole 12 of the shoe 10. The anchors 40 may include a pivot receiver 42. The pivot receiver 42 receives the first crutch pivot peg 38, thereby pivotally attaching the crutch bracket 32 and the anchor 40.

The wheel base 44 of the present invention may include a first side, a second side, a front end, a rear end, a top surface and a bottom surface. A track guide slot 48 is formed from the first side to the second side on the bottom surface. The track stem 28 slidably engages within the track guide slot 48 from the first side to the second side. In certain embodiments, the track guide slot 48 forms a downturn 58 on the second side curving away from the upper surface and securing the track stem 28 within during the retracted position. The wheel base 44 further includes a locking slot 50 formed on the first side on the top surface. An opening may be formed through the top and bottom surface in between the locking slot 50 and the second side of the wheel base 44. Guide notches 52 may protrude into the opening and a platform 54 may be attached to the notches 52 and suspended above the opening. The wheel base 44 may further include a spring anchor 56 protruding from the upper surface in between the locking slot 50 and the opening. A plurality of guides 46 may also protrude from the upper surface of the wheel base 44.

The present invention may further include locking mechanisms to lock the wheel assembly in the deployed position and retracted position. A hook lock 60 slidably engages laterally within the locking slot 50. The hook lock 60 includes a tip 62 and an angled push surface 64 opposite the tip 62. The locking mechanism further includes a wheel bracket lock 66 that includes tracks 68 to receive and vertically slide along guide notches 52. The wheel bracket lock 66 further includes a face 72 opposite the tracks 68. A curved track 70 is formed on the face 72 running from the top end to the bottom end of the wheel bracket lock 66. A spring 92 is suspended between the wheel bracket lock 66 and platform 54.

The locking mechanism further includes a ram 74 including a ram lever 84. The ram 74 includes side rails 76 slidably engaged with and secured to the wheel base 44 by the guides 46. A cross rail 80 attaches the side rails 76 together and includes a spring anchor 82. A spring 88 attaches the spring anchor 82 to the spring anchor 56 on the wheel base 44, biasing the ram lever 84 towards the wheel base 44. The ram lever 84 may be attached to the first side rail 76 and the second side rail 76. The first side rail 76 includes an angled protrusion 78 which abuts the angled push surface 64 of the hook lock 60. A spring 90 attaches the spring anchor 56 and the angled push surface 64 and biases the angled push surface 64 against angled protrusion 78. The second side rail 76 includes a pin 86 protruding into and slidably engaged within the curved track 70.

In use, the present invention is in the locked position when the wheel brackets 26 are pivoted towards and adjacent to the wheel base 44. The tip 62 of the hook lock 60 is extending past the wheel base 44 and the hook 36 is hooked onto the hook lock 60, thereby locking the wheel brackets 26 against the wheel base 44. To unlock the present invention and transform the retracted position to the deployed position, the ram lever 84 is pulled. When the ram lever 84 is pulled, the angled protrusion 78 presses against the angled push surface 64 so that the tip 62 of the hook lock 60 recesses inwards towards the wheel base 44. The hook 36 thereby unhooks from the hook lock 60, and the wheel bracket 26 pivots with the pivoting crutch bracket 32. The wheel brackets 26 pivot to a point where the wheels 24 are perpendicular to the wheel base 44, and thereby fully deployed.

The wheel bracket lock 66 locks the wheel brackets 26 in the deployed position. As mentioned above, the ram lever 84 is pulled to transform from the locked and retracted position to the unlocked and deployed position. To lock the wheel brackets 26 in the deployed position, the ram lever 84 is released. Due to the spring 88, the ram 74 is pulled towards the wheel base 44. The pin 86 slides within the curved track 70 pushing the wheel bracket lock 66 downwards and away from the wheel base 44. The wheel bracket lock 66 abuts the lock corner 29 of the wheel bracket 26 locking the wheel bracket 26 in the deployed position.

To reverse the process and transform the present invention back to the retracted position, the ram lever 84 may be pulled again. By pulling the ram lever 84, the pin slides 86 in the opposite direction within the curved track 70, pulling the wheel bracket lock 66 upwards and within the wheel base 44. This allows the wheel bracket 26 to pivot towards the wheel base 44. Once the wheel bracket 26 is pivoted all the way back to the wheel base 44, the ram lever 84 may be released. When releasing the ram lever 84, the angled protrusion 78 and the angled push surface 64 slide back together. The tip 62 is pushed past the edge of the wheel base 44 and into the hook 36, thereby locking the shoe 10 into the retracted position.

It should be understood, of course, that the foregoing relates to exemplary embodiments of the invention and that modifications may be made without departing from the spirit and scope of the invention as set forth in the following claims.

What is claimed is:

1. An inline skating shoe comprising:

a sole on a bottom of the shoe comprising a wheel recess;

at least one wheel assembly within the wheel recess, wherein the at least one wheel assembly comprises:

a wheel base attached to the sole, wherein the wheel base comprises at least one guide rail and a hook lock;

a wheel bracket pivotally attached to the wheel base, wherein the wheel bracket comprises a hook; and at least one wheel rotatably secured to the wheel bracket;

wherein the at least one wheel assembly comprises a deployed position comprising the wheel bracket pivoting away from the wheel base and a retracted position comprising the wheel bracket pivoting towards the wheel bases; and a locking mechanism operable to lock the wheel assembly in the deployed position and retracted position, wherein the locking mechanism comprises a ram comprising a ram lever and at least one side rail extending from the ram lever, wherein the at least one side rail is slidably disposed within the guide rail, wherein the at least one side rail slides to engage with the hook lock and thereby releasably attaches and detaches the hook lock from the hook.

2. The inline skating shoe of claim 1, wherein the at least one wheel assembly is a plurality of wheel assemblies.

3. The inline skating shoe of claim 1, wherein the wheel assembly further comprises a crutch comprising a first end opposite to a second end, wherein the first end is pivotally mounted to the sole by an anchor and the second end is pivotally mounted to an outer surface of the wheel bracket.

4. The inline skating shoe of claim 3, wherein the wheel bracket comprises a top end comprising a first corner and a second corner, wherein the first corner comprises a track stem slidably engaged with a track guide slot formed in the wheel base.

5. The inline skating shoe of claim 1, wherein the hook lock is laterally slidable within a locking slot formed in the wheel base, wherein the hook lock comprises a tip and an angled push surface opposite the tip, wherein the hook lock is biased away from wheel base by a spring, and the at least one side rail comprises an angled protrusion mating with the angled push surface of the hook lock, wherein the ram is biased towards the wheel base by a spring, wherein the tip protrudes laterally past the wheel base in a locked position, wherein the angled protrusion pushes the angled push surface towards a center of wheel base and the tip is recessed within the wheel base in an unlocked position when the ram lever is pulled away from the wheel base.

6. The inline skating shoe of claim 5, wherein the crutch comprises the hook protruding from an inner surface, and wherein the retracted position further comprises the hook attached to the tip.

7. The inline skating shoe of claim 1, wherein the locking mechanism further comprises:

a wheel bracket lock vertically slidable within an opening formed in the wheel base, wherein the wheel base comprises a platform suspended above the opening, and wherein the wheel bracket lock is attached to the platform by a spring; and the at least one side rail comprises a pin protruding into a sloped channel formed on an outside surface of the wheel bracket lock, wherein the ram is biased towards the wheel base by a spring;

wherein a bottom of the wheel bracket lock protrudes downwards past the wheel base in a locked position and wherein when the ram lever is pulled away from the wheel base the pin slides along the sloped channel so that the wheel bracket lock is pulled upward towards the platform and is recessed within the wheel base in an unlocked position.

8. The inline skating shoe of claim 7, wherein the deployed position further comprises the wheel bracket lock abutting the second corner.

9. The inline skating shoe of claim 1, wherein the retracted position comprises the wheel bracket parallel with the wheel base, and the deployed position comprises the wheel bracket perpendicular with the wheel base.

10. The inline skating shoe of claim 1, further comprising a plurality of bumpers attached to the sole and forming the wheel recess, wherein the plurality of bumpers protrude from the sole beyond the wheel in the retracted position.

11. An inline skating shoe comprising:

a sole on a bottom of the shoe comprising a wheel recess;

at least one wheel assembly within the wheel recess and aligned from a front of the sole to a rear of the sole, wherein the at least one wheel assembly comprises:

a wheel base attached to the sole;

a wheel bracket pivotally attached to the wheel base, wherein the wheel bracket comprises a top end comprising a first corner and a second corner, wherein the first corner comprises a track stem slidably engaged with a track guide slot formed in the wheel base; and at least one wheel rotatably secured to the wheel bracket;

a crutch comprising a first end opposite to a second end, wherein the first end is pivotally mounted to the sole by an anchor and the second end is pivotally mounted to an outer surface of the wheel bracket, wherein the at least one wheel assembly comprise a deployed position comprising the wheel bracket pivoting away from the wheel base and a retracted position comprising the wheel bracket pivoting towards the wheel bases; and a locking mechanism operable to lock the wheel assembly in the deployed position and retracted position.

12. The inline skating shoe of claim 11, wherein the locking mechanism comprises:

a hook lock laterally slidable within a locking slot formed in the wheel base, wherein the hook lock comprises a tip and an angled push surface opposite the tip, wherein the hook lock is biased away from wheel base by a spring; and a ram comprising at least one side rail slidably attached to the wheel base and comprising an angled protrusion mating with the angled push surface of the hook lock, wherein the ram is biased away from the wheel base by a spring, wherein the tip protrudes laterally past the wheel base in a locked position, wherein the angled protrusion pushes the angled push surface towards a center of wheel base and the tip is recessed within the wheel base in an unlocked position when the ram is pulled away from the wheel base.

13. The inline skating shoe of claim 12, wherein the crutch comprises a hook protruding from an inner surface, and wherein the retracted position further comprises the hook attached to the tip.

14. The inline skating shoe of claim 11, wherein the locking mechanism comprises:

a wheel bracket lock vertically slidable within an opening formed in the wheel base, wherein the wheel base comprises a platform suspended above the opening, and wherein the wheel bracket lock is attached to the platform by a spring; and a ram comprising at least one side rail slidably attached to the wheel base and comprising a pin protruding into a sloped channel formed on an outside surface of the wheel bracket lock, wherein the ram is biased away from the wheel base by a spring;

wherein a bottom of the wheel bracket lock protrudes downwards past the wheel base in a locked position and wherein when the ram is pulled the pin slides along the sloped channel so that the wheel bracket lock is pulled upward towards the platform and is recessed within the wheel base in an unlocked position.

* * * * *